US008480409B2

(12) United States Patent
Paine et al.

(10) Patent No.: US 8,480,409 B2
(45) Date of Patent: Jul. 9, 2013

(54) METHOD FOR RF CONNECTOR GROUNDING

(75) Inventors: Waid A. Paine, McKinney, TX (US); Lucian A. Brasier, Plano, TX (US); James E. Lewis, Allen, TX (US); Thomas H. Taylor, Wylie, TX (US); Lauren M. Garcia, Dallas, TX (US)

(73) Assignee: Raytheon Company, Waltham, MA (US)

( * ) Notice: Subject to any disclaimer, the term of this patent is extended or adjusted under 35 U.S.C. 154(b) by 129 days.

(21) Appl. No.: 12/966,971

(22) Filed: Dec. 13, 2010

(65) Prior Publication Data

US 2012/0156902 A1 Jun. 21, 2012

(51) Int. Cl.
*H01R 12/00* (2006.01)

(52) U.S. Cl.
USPC ..... 439/63

(58) Field of Classification Search
USPC ..... 439/63, 579, 581
See application file for complete search history.

(56) References Cited

U.S. PATENT DOCUMENTS

| | | | | |
|---|---|---|---|---|
| 4,669,805 | A * | 6/1987 | Kosugi et al. | 439/581 |
| 4,867,704 | A | 9/1989 | Standke | |
| 5,532,659 | A | 7/1996 | Dodart | |
| 6,457,979 | B1 | 10/2002 | Dove et al. | |
| 7,665,998 | B2 * | 2/2010 | Kressner et al. | 439/63 |

* cited by examiner

*Primary Examiner* — Phuong Dinh
(74) *Attorney, Agent, or Firm* — Christie, Parker & Hale, LLP

(57) ABSTRACT

The present invention relates to radio frequency and microwave connectors, and more particularly to grounding methods for printed wiring board edge-launch connectors. The grounding method comprises conducting tabs secured to a PWB and to an attached connector frame holding coaxial connectors. The conducting tabs thus provide a ground connection between the connector frame and one or more ground conductors on the PWB.

11 Claims, 5 Drawing Sheets

METHOD FOR RF CONNECTOR GROUNDING

STATEMENT REGARDING FEDERALLY SPONSORED RESEARCH OR DEVELOPMENT

This invention was made with U.S. Government support under contract No. 06C2908 awarded by the Department of Defense. The U.S. Government has certain rights in this invention.

FIELD

The present invention relates to radio frequency and microwave connectors, and more particularly to grounding methods for printed wiring board edge-launch connectors.

BACKGROUND

Printed wiring boards (PWBs) are used extensively to produce electronic circuits. PWBs are typically formed as sandwiches of one or more layers of dielectric material and one or more layers of conductive material, in which the conductive material may be formed, by etching, into patterns including lines, known as traces, which form connections in a circuit. Holes with conductive walls, known as vias, may be formed in the dielectric layers to provide electrical connections between conductive layers.

A circuit on a PWB may include connectors, and components such as resistors, capacitors, or transistors, which may be installed on the PWB by applying solder paste to the outer conductive layer at the locations where the components are to be installed, placing the components on the PWB, and heating the assembly in a solder reflow oven which melts the solder, soldering the components in place. Alternately, conductive epoxy may be used instead of solder.

Coaxial connectors known as board edge-launch connectors may be installed at the edge of a PWB to provide connections to other parts of a system. For example, a PWB with an array of connectors along one edge may be installed in a system by sliding it into a chassis so that the connectors on the PWB connect simultaneously to an array of corresponding mating connectors in the chassis. Such an arrangement, in which there is no opportunity for a human operator or technician to align and connect the connectors individually and where the technician may not be able to see the connectors, is known as a blind-mate application.

Coaxial connectors individually soldered to a PWB may be unsuitable for use in a blind-mate application because the process for soldering such connectors to a PWB may not produce sufficiently precise alignment to allow each connector to connect reliably with the corresponding connector in an array, such as in the chassis-based system described above. In such a case it may be helpful to use a single rigid part known as a connector frame to hold all of the connectors, and to maintain their alignment relative to each other and to a PWB. It may also be convenient to have the connector frame secured to the bottom surface of the PWB, providing a ground connection between the connector frame and a ground conductor on the bottom surface of the PWB.

When a connector frame is used with coaxial connectors, it may be necessary to provide ground connections also between the outer conductors of the connectors and ground conductors on the top surface of the PWB. Moreover, when the connectors will be carrying high-frequency signals, such as radio frequency (RF) or microwave signals, it may be necessary to have a continuous connection from the connector frame to one or more ground conductors on the top surface of the PWB, forming a transmission line, so that the characteristic impedance of the signal path will be uniform and to prevent reflection or radiation of the signal.

A connection between the connector frame and the top-layer ground conductors may be formed by bonding wires to the connector frame and to top-layer ground conductors near the edge of the PWB. A bond wire, however, generally follows a curved path through air between the bond pads it connects. This causes the corresponding part of the signal path to have a different, and generally high, characteristic impedance, and if the wire bonds are applied under manual control, the wire path and the characteristic impedance may suffer from poor repeatability. Moreover, wire-bonding machines may be designed to work with relatively small parts, and a PWB with a connector frame may be too large to fit into such a machine.

Another means of forming a ground connection between the connector frame and a top-layer ground involves applying a globule of conductive epoxy manually to a ground conductor near the edge of the PWB and to a nearby surface of the connector frame, so that the epoxy bridges the gap between the connector frame and the top-surface ground conductor on the PWB. This method is unsatisfactory, primarily because of the conflicting requirements of (i) applying a sufficient quantity of epoxy to ensure that the gap is bridged by the epoxy and that contact is made reliably with both the connector frame and the PWB, and (ii) applying a sufficiently small quantity of epoxy that it will not flow to other nearby conductors, thereby forming unwanted short circuits. These difficulties may be compounded by variations in gap width resulting from fabrication tolerances, and from the poor repeatability of a manual process.

Thus, there is a need for a system for providing connections between a conductive connector frame and one or more conductive areas on the top surface of a PWB.

SUMMARY

Embodiments of the present invention provide a repeatable ground connection between a connector frame and conductors on the surface of a PWB. One aspect of embodiments of the present invention allows a signal path to maintain a uniform characteristic impedance between coaxial connectors and PWB transmission lines, by providing continuous ground paths from a connector frame to ground conductors on the PWB. Exemplary embodiments of the invention accomplish this by providing contact surfaces on the connector frame and on the PWB, and conductive tabs which may be soldered or adhered to both the connector frame and the PWB, to provide conductive ground paths from one to the other.

In one embodiment, a system for forming a plurality of electrical connections to one or more conductive areas on a PWB comprises a connector frame attachable to a PWB, wherein the connector frame has at least one surface portion adjacent each of the conductive areas of the PWB, and each of the surface portions is electrically connectible to a conductive tab, to connect the surface portion of the connector frame to one of the conductive areas of the PWB. In one embodiment the system comprises flat tabs for connecting one or more of the surface portions of the connector frame to one or more of the conductive areas of the PWB.

In one embodiment, a method of forming a plurality of ground connections between conductive areas on a PWB and a connector frame for holding coaxial connectors includes providing the connector frame with at least one surface portion adjacent each of the conductive areas on the PWB; securing one or more conductive tabs to one or more of the surface portions; and securing one or more of the conductive tabs to one or more of the conductive areas.

BRIEF DESCRIPTION OF THE DRAWINGS

These and other features and advantages of the present invention will become appreciated as the same become better understood with reference to the specification, claims and appended drawings, wherein:

DETAILED DESCRIPTION

The detailed description set forth below in connection with the appended drawings is intended as a description of the presently preferred embodiments of a method for RF connector grounding provided in accordance with the present invention and is not intended to represent the only forms in which the present invention may be constructed or utilized. The description sets forth the features of the present invention in connection with the illustrated embodiments. It is to be understood, however, that the same or equivalent functions and structures may be accomplished by different embodiments that are also intended to be encompassed within the spirit and scope of the invention. As denoted elsewhere herein, like element numbers are intended to indicate like elements or features.

As used herein, the term "PWB" means any combination of one or more insulating, dielectric, or semiconductor layers with one or more complete or partial conducting layers, and includes without limitation polymer on metal, ceramic substrates, GaAs and GaN chips, and combinations in which the dielectric material is glass reinforced epoxy, a Teflon-based material, or alumina, and in which the conducting material contains copper or copper and other metals.

Figure 1:
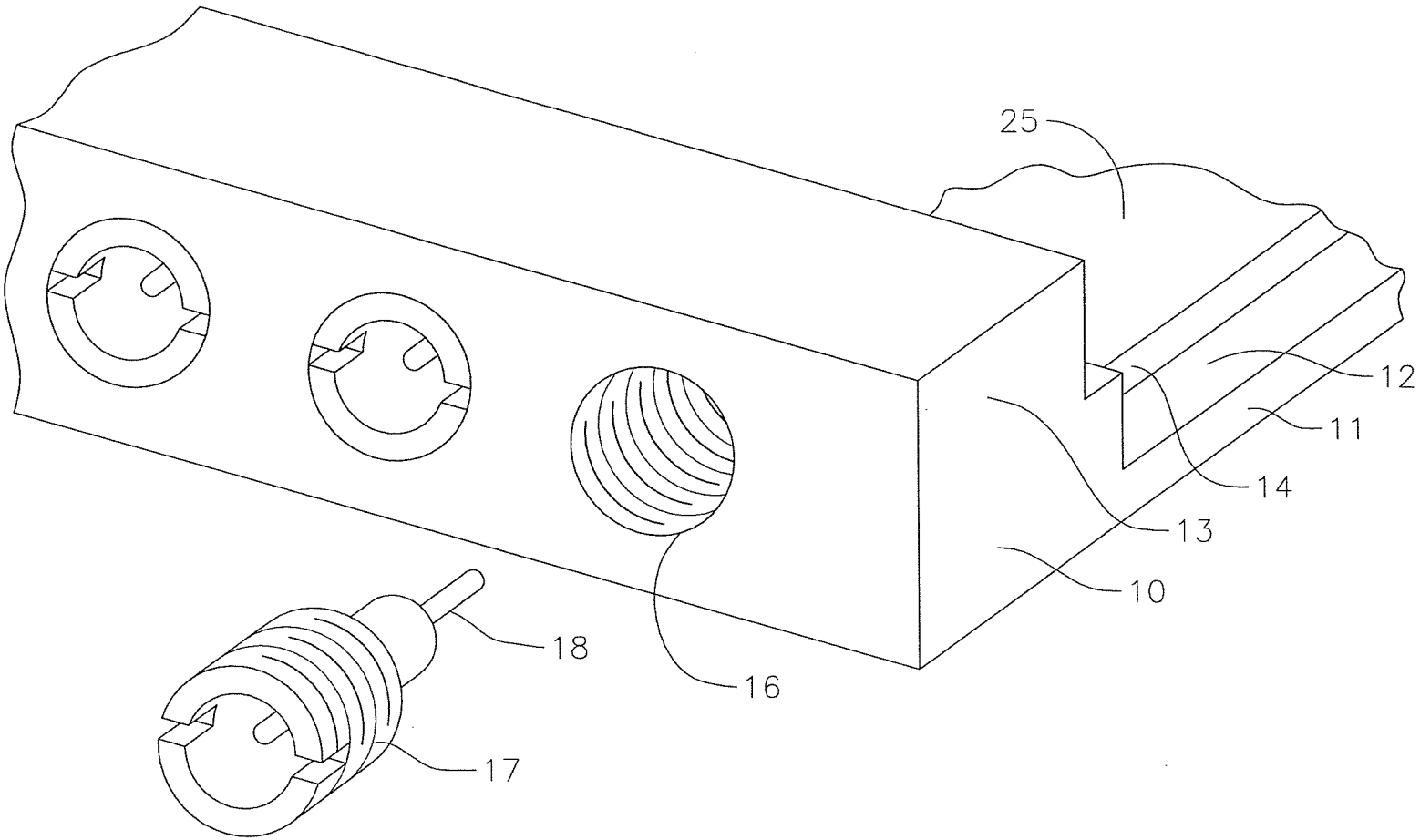
FIG. 1 is a fragmentary front perspective view of a portion of a grounding system provided according to an embodiment of the invention.
Figure 2:
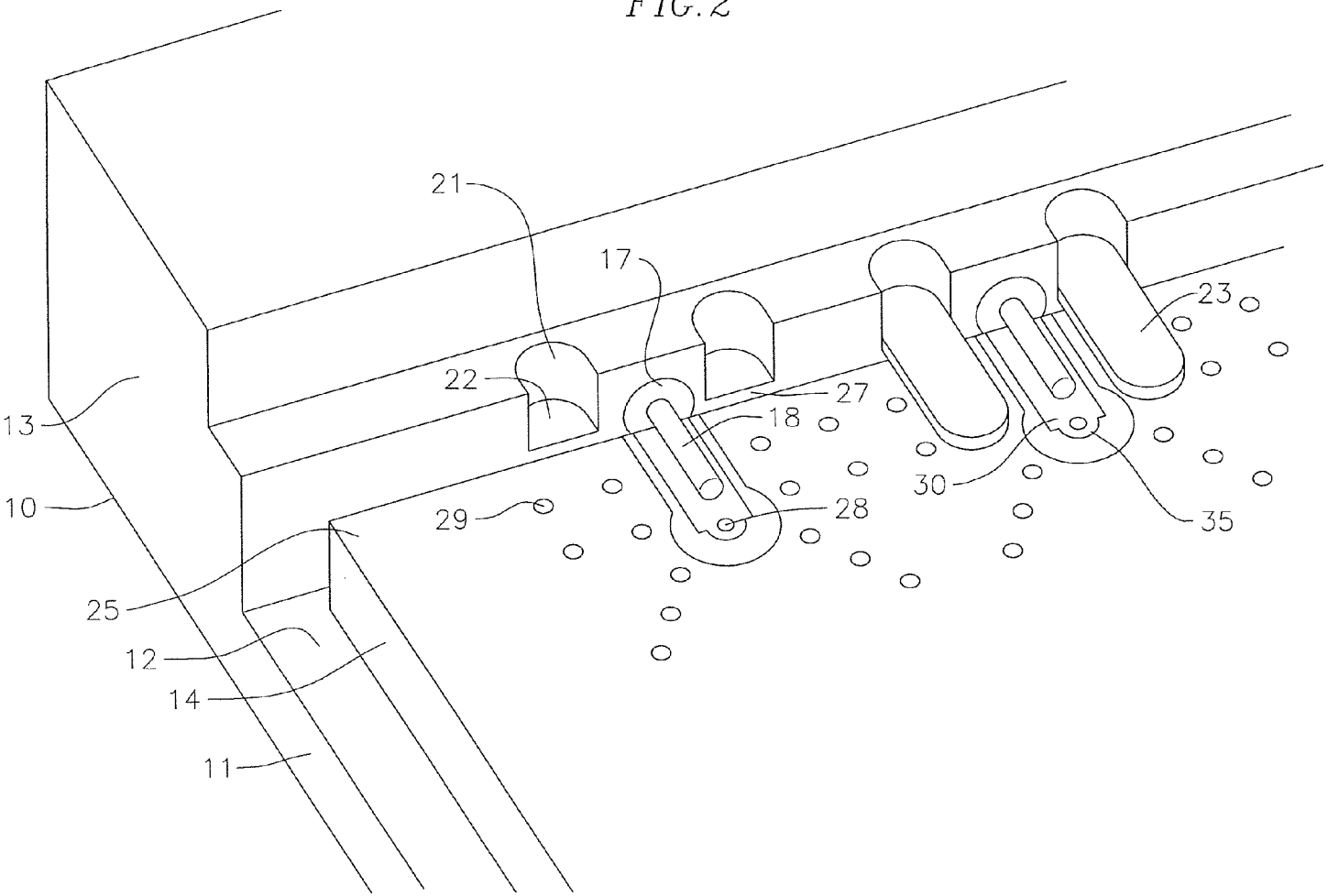
FIG. 2 is a rear perspective view of the grounding system of FIG. 1.

Referring to FIG. 1 and FIG. 2, in the embodiment shown a connector frame 10 includes a plate portion 11 forming a PWB shelf 12 for supporting a PWB 14, and also includes a wall portion 13 extending along one edge of the PWB 14. The PWB 14 is secured to the PWB shelf 12. Threaded holes 16 in the wall portion 13 accept coaxial connectors 17 with threaded bodies. In one embodiment, the threaded holes 16 may be through holes 0.035 inches in diameter, counterbored with a diameter of 0.148 inches to a depth of 0.167 inches, and the counterbored portion may be threaded with a 0.164-64 UNS-2B thread, to a minimum depth of 0.138 inches. The connector frame 10 may be fabricated from a single piece of metal or assembled from several pieces, and it may be formed of conductive materials other than metal, or of a combination of conductive and insulating materials.

In the embodiment shown in FIG. 2, a relief cut 21 on each side of each threaded hole 16 forms a tab shelf 22 at the same height as the top surface of the top layer ground conductor 25. On either side of each connector 17, a ground tab 23 is secured to both the tab shelf 22 and to an adjacent area on the top layer ground conductor 25 using solder or conductive epoxy (element 26 of FIG. 4). Except where it may cross a relatively small gap 27 between the PWB 14 and the connector frame 10, the ground tab 23 does not produce an air gap between the signal conductor and ground conductors. As a result this system provides a signal path with a more uniform and more repeatable characteristic impedance than a pair of bond wires.

For clarity of illustration, FIG. 2 shows the system with ground tabs 23 installed at one of the coaxial connectors 17 and not yet installed at another, so that the tab shelves 22 are visible at the latter location.

The invention is described herein in relation to an array of coaxial RF connectors 17, but the invention is not limited to this application, and may be used in other types of connector assemblies, such as triaxial connectors or coaxial connectors intended for use at other frequencies.

In one embodiment, the center conductors 18 of the coaxial connectors 17 extend just above the top surface of the top layer signal trace 30 on the PWB 14. The distance between the PWB shelf 12 and the centerline of any of the threaded holes 16 may preferably be chosen such that when the PWB 14 is installed on the PWB shelf 12, the clearance between the top layer signal trace 30 on the PWB 14 and the center conductor 18 of the connector 17 is sufficiently large to allow the connector 17 to be installed in the threaded hole 16, and also sufficiently small to allow a reliable connection between the center conductor 18 and the corresponding top layer signal trace 30 to be formed. For example, it may be preferable to have the clearance be sufficiently small that during a soldering or gluing operation molten solder or conductive epoxy (element 26 of FIG. 4) will bridge the gap between the center conductor 18 and the corresponding top layer signal trace 30. In an exemplary embodiment the thickness of the conductive epoxy film (element 15 of FIG. 4) between the PWB shelf 12 and the PWB 14 may be 0.005 inches, the thickness of the PWB 14 may be 0.036 inches, the diameter of the coaxial connector center conductor 18 may be 0.012 inches, and the distance between the center line of the threaded hole 16 and the PWB shelf 12 may be 0.049 inches, resulting in a nominal clearance between the center conductor 18 and the top layer signal trace 30 of 0.002 inches.

The relief cuts 21 may be formed by any suitable method, in one embodiment as part of the process of machining the connector frame 10 using a milling machine under computer numerical control, also known as a CNC machine. In this case each of the relief cuts 21 may be formed using an end mill; the same end mill may also be used to machine other surfaces of the connector frame 10. The width of the relief cut 21 in this case may be greater than or equal to the diameter of the end mill used for this operation. In embodiments of the present invention, the connector frame 10 may be made of a material having a coefficient of thermal expansion similar to that of the PWB 14, such as an aluminum-silicon alloy containing 72% aluminum and 28% silicon.

The PWB 14 may be fabricated from conductive layers made of copper and dielectric layers made of a Teflon-based material such as CLTE sold by Arlon-MED of Rancho Cucamonga, Calif., which may have a glass weave imbedded in it. In another embodiment, similar material sold by Rogers Corporation, of Chandler, Ariz., may be used. The glass weave may control the coefficient of thermal expansion of the dielectric layers so that it is similar to that of the copper conductive layers.

In exemplary embodiments, after the PWB 14 has been secured to the connector frame 10, connectors 17 with threaded bodies are installed in the connector frame 10 by threading them into the threaded holes 16 and tightening them to the torque specified by the manufacturer of the connectors 17. The connectors 17 may in certain embodiments be SMPM connectors, with part number 18S103-500L5, sold by Rosenberger of North America, LLC, of Lancaster, Pa. In other embodiments they may be GPPO connectors, with part number B003-L33-02, sold by Corning Gilbert Incorporated of Glendale, Ariz. Similar or equivalent connectors may be available from other vendors including W. L. Gore & Associates, Incorporated, of Newark, Del., and DDi Corporation of Anaheim, Calif.

In one embodiment, the ground tabs 23 are oblong with a width of 0.025 inches, a length of 0.125 inches, and rounded ends with radii of curvature equal to half of the width. The relief cuts 21 may be slightly wider than the ground tabs 23 to permit the latter to fit into place easily. In such an embodiment the relief cuts 21 may have a width of 0.032 inches.

Figure 3:
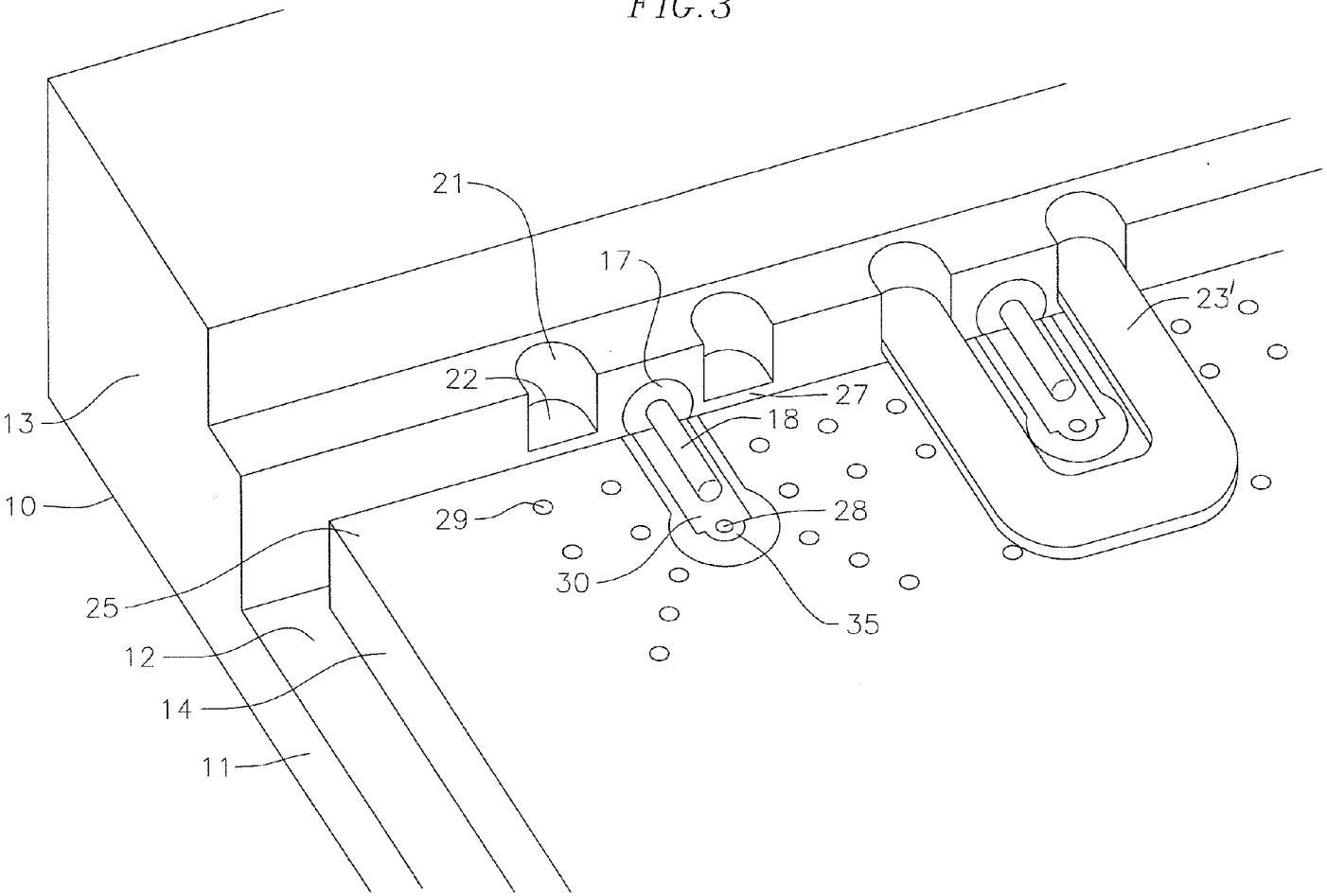
FIG. 3 is a rear perspective view of the grounding system of FIG. 1 according to another embodiment of the invention.

In another embodiment, shown in FIG. 3, U-shaped ground tabs 23' may be used in place of pairs of oblong ground tabs 23 of the kind illustrated in FIG. 2. The two arms of each U-shaped ground tab 23' may have widths of 0.025 inches, rounded ends with radii of curvature of 0.0125 inches, and a gap of 0.055 inches between the arms of the U. Each U-shaped ground tab 23' may have an overall width of 0.105 inches and an overall length, measured in the direction parallel to the arms of the U, of 0.1531 inches.

The ground tabs 23 may, in an exemplary embodiment, be fabricated from a sheet of brass, 0.005 inches thick. In another embodiment, a sheet of another metal may be used. A metal having a coefficient of thermal expansion similar to that of the top conductive layer of the PWB 14 may minimize stresses that otherwise could result from differential thermal expansion or contraction with changes in temperature. It may be preferable to plate the ground tabs 23 with another metal or metals to provide a better bond during installation and to prevent galvanic corrosion. An etching process may be used to fabricate the ground tabs 23. An etch-resistive film, in the shape that is to remain after etching, may be formed on both sides of a sheet of brass. After the formation of this film the sheet of brass may be etched from both sides. After etching, the sheet may contain a number of ground tabs 23, each still connected to a supporting strip of the sheet by a narrow support finger of metal. In an exemplary embodiment, this etched sheet may then be plated with a layer of nickel 0.0001 to 0.0002 inches thick, and subsequently plated with a layer of gold 0.00001 to 0.00002 inches thick. Shearing the support fingers in such an embodiment releases the ground tabs 23 from the supporting strip, completing the process of fabricating the ground tabs 23. In another embodiment, the ground tabs 23 may be punched from a sheet of metal, which may first have been plated with one or more other metals.

Figure 4B:
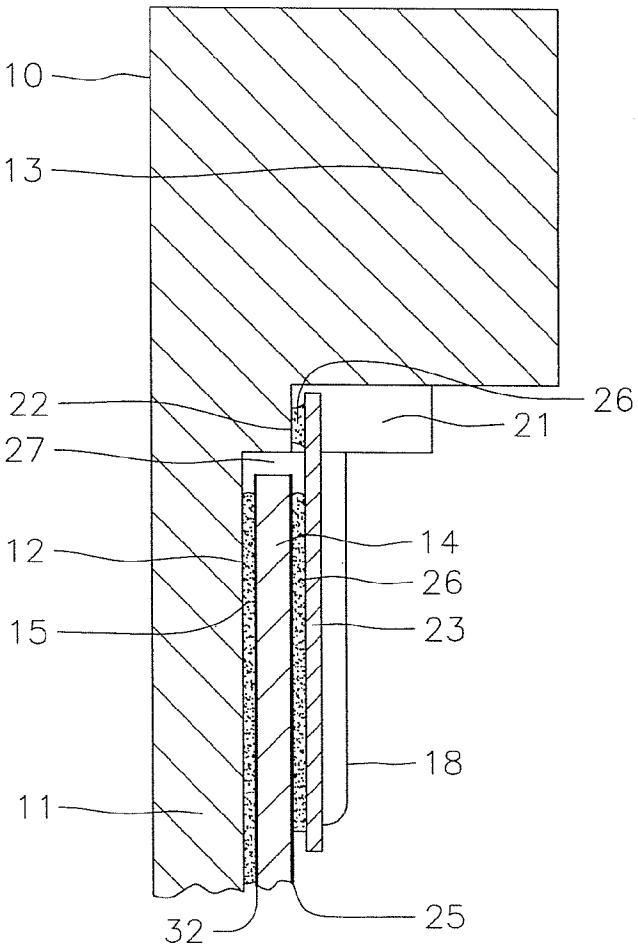
FIG. 4B is a cross-sectional view of the embodiment of FIG. 2 taken along the offset cutting plane shown in FIG. 4A.
Figure 4A:
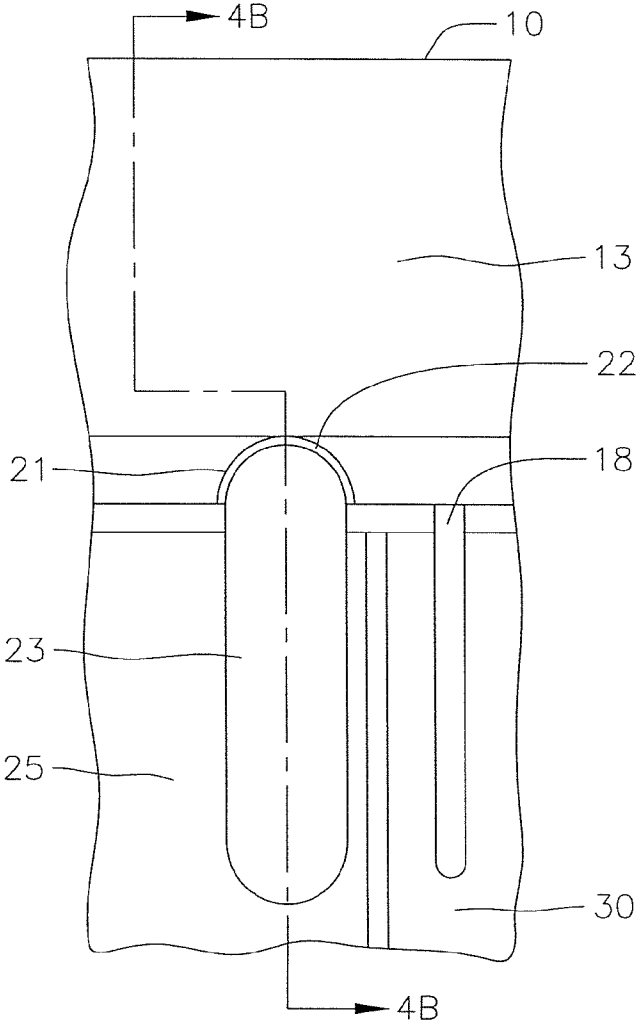
FIG. 4A is a fragmentary top plan view of a portion of the embodiment of FIG. 2, showing an offset cutting plane used to generate FIG. 4B.

Referring to FIG. 4, in one embodiment, the PWB 14 may be secured to the PWB shelf 12 using a conductive epoxy film 15 such as Ablestik ABLEFILM 561, a glass supported, modified epoxy adhesive film sold by Henkel Corporation, of Rocky Hill, Conn. The conductive epoxy film 15 may be applied to the PWB shelf 12, the PWB 14 placed on the conductive epoxy film 15, and the subassembly heated in an oven to cure the conductive epoxy film 15. After the PWB 14 is secured to the connector frame 10, a dab of conductive epoxy 26 may be applied to each tab shelf 22, and to a point, on the top layer ground conductor 25, adjacent to each tab shelf 22. A ground tab 23 may then be placed across the gap 27 so that one end of the ground tab 23 is over the tab shelf 22 and the other end is over the top layer ground conductor 25. In this embodiment the conductive epoxy 26, both between the ground tab 23 and the tab shelf 22, and between the ground tab 23 and the top layer ground conductor 25, is sandwiched between closely spaced parallel surfaces, and prevented by its adhesion to these surfaces from flowing to other parts of the structure, where it could otherwise cause unwanted short circuits. The conductive epoxy 26 may be one that remains compliant after curing, to reduce the risk that differential thermal expansion of the parts joined by the conductive epoxy 26 may cause the conductive epoxy 26 to fracture. In one embodiment, the conductive epoxy 26 may be Ablestick 8175, which is sold by Henkel Corporation. In another embodiment, dabs of solder paste may be used in place of conductive epoxy 26, and the subassembly may be subsequently heated in a reflow oven to form solder joints at the locations of the solder paste. The dabs of conductive epoxy 26 or of solder paste may, in an exemplary embodiment, be applied under computer control by a dispensing machine. In another embodiment the dabs may be applied manually.

The ground tabs 23 may be sufficiently small and of sufficiently low mass for handling with a pick-and-place machine and in one embodiment may be placed on the PWB 14 using such a machine. In another embodiment the tabs may be installed manually. In yet another embodiment a comb-shaped strip of sheet of metal may include multiple ground tabs and may be installed on the PWB 14 and the tab shelves 22 in one manual operation.

It may be possible to install the ground tabs 23 on the PWB 14 at the same time, and using the same equipment, as other components, improving the efficiency of the assembly process. For example, solder paste may be applied to the tab shelves 22 and to various points on the top surface conductors of the PWB 14. The components may then be placed on the PWB 14 and the ground tabs 23 on the PWB 14 and on the tab shelves 22 in a subsequent step, and all of the solder joints formed simultaneously in a subsequent solder reflow step.

Figure 5A:
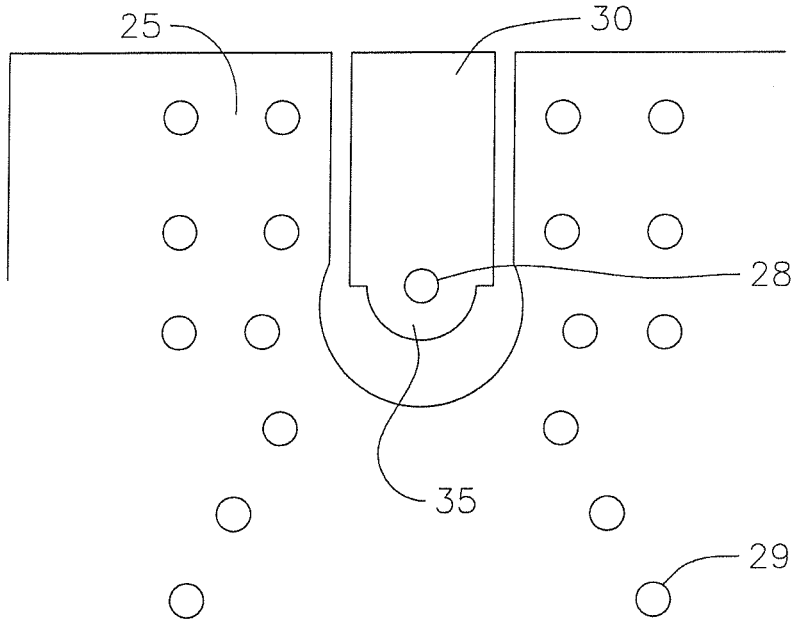
FIG. 5A is a top view of the top conductive layer of a PWB according to an embodiment of the invention.
Figure 5B:
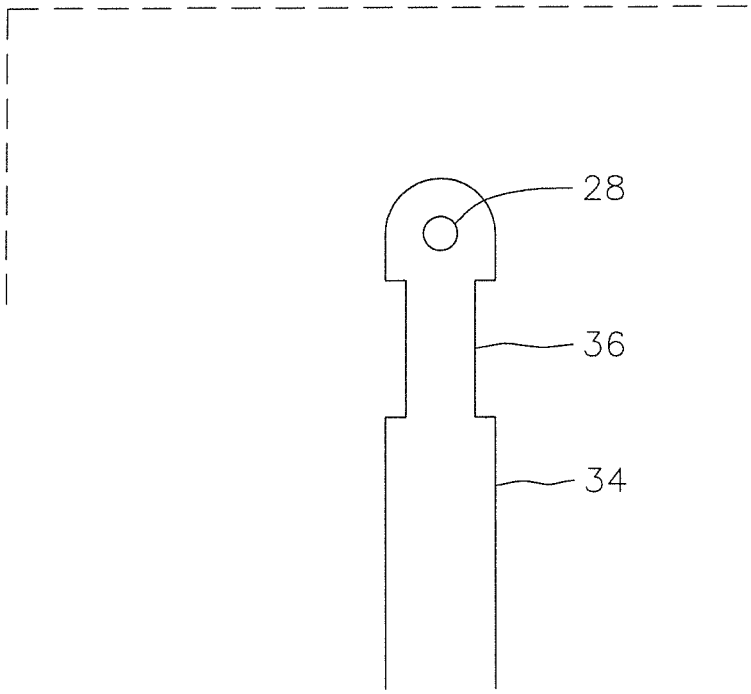
FIG. 5B is a top view of the middle conductive layer of a PWB according to an embodiment of the invention.

FIG. 5 shows an exemplary arrangement of the top and middle conductive layers for an embodiment in which the PWB 14 has three conductive layers. A transition from coaxial transmission line to a transmission line geometry known as "coplanar-over-ground" is formed at the edge of the PWB 14. As used herein the term "coplanar over ground" delineates a geometry of conductors used for a microwave transmission line including a top layer signal trace 30, a top layer ground conductor 25, or a pair of such conductors, extending to both sides of the top layer signal trace 30, and a bottom layer ground 32 (FIG. 4). A second transition to another transmission line configuration may be formed near the first transition.

Referring to FIG. 5, the second transition may for example be from coplanar-over-ground to stripline. In this case, the signal path may be routed from the top layer signal trace 30 to the middle layer signal trace 34 using a signal via 28. The signal via 28 may be back-drilled through the bottom layer with a drill bit having a diameter slightly larger than the diameter of the signal via 28, to a depth extending almost to the middle conductive layer, to remove the conductive material from the lower half of the signal via 28, where it would otherwise contact, or be unacceptably close to, the bottom layer ground 32 and the PWB shelf 12 (FIG. 4). A signal via pad 35, an annular region of conductor, may surround, or partially surround, the signal via 28. A cage of ground vias 29 may be used for mode suppression as illustrated in the exemplary embodiment of FIG. 5 to reduce loss in the structure. In an embodiment in which U-shaped ground tabs 23' are employed (FIG. 3), the top layer ground conductor 25 on the PWB 14 extends past the edge of the U-shaped ground tab 23' at all edges of the U-shaped ground tab 23' except at the edge of the PWB 14. This ensures that the gap between the signal path and the nearest ground on the PWB 14 is determined everywhere by the edge of the top layer ground conductor 25, and not by the placement of the U-shaped ground tab 23' on the PWB 14. In one embodiment the bottom layer ground 32, shown in FIG. 4, may be a solid conductive sheet except for holes at the locations of vias.

Adjustments to the dimensions of the conductors on the PWB 14 may be made to provide as uniform as possible a characteristic impedance along the signal path, and to minimize reflections and radiation along the path. These adjustments may be made using electromagnetic field simulation software such as Ansoft HFSS, sold by Ansys Incorporated, of Canonsburg, Pa. Using such software, a designer, in implementing the present invention, may define two ports in the system, one at the coaxial connector 17, and one at a point on the PWB 14. In an embodiment having a second transition from coplanar-over-ground to stripline, for example, the second port may be on the stripline transmission line. The designer may then use the simulation software to calculate the four complex S-parameters for this two port system, where the magnitudes of $S_{11}$ and $S_{22}$ indicate the return loss and the magnitudes of $S_{12}$ and $S_{21}$ indicate the insertion loss. If the insertion loss is larger than expected it may indicate that the signal path will radiate electromagnetic power, which may be undesirable. The designer may use the simulation software to display the impedance corresponding to $S_{11}$ or to $S_{22}$ on a Smith chart, on which the desired characteristic impedance is the center point, the upper half corresponds to impedances which are more inductive than the desired characteristic impedance, and the lower half corresponds to impedances which are more capacitive than the desired characteristic impedance.

The designer may then, in a process known as tuning, adjust conductor dimensions until the design meets its requirements for return loss and insertion loss, over the frequency range of interest. To eliminate excess capacitance, the designer may for example reduce the width of the top layer signal trace 30, increase the gaps between the top layer signal trace 30 and the regions of the top layer ground conductor 25 on both sides of the signal trace, decrease the diameter of the signal via 28, decrease the diameter of the signal via pad 35, enlarge the cage of ground vias 29, or increase the gap between the signal via pad 35 and the adjacent top layer ground conductor 25. When enlarging the cage of ground vias 29, the designer may need to observe the insertion loss, which may become unacceptable if the ground vias 29 are moved too far from the transitions. To eliminate excess inductance, the designer may adjust, for example, any of these same parameters in the opposite direction. In a subsequent step, the designer may if necessary further reduce the capacitance of the structure by narrowing the middle layer signal trace 34 along a portion of its length, forming an inductive section 36, and then adjust the length and width of the inductive section 36 to further improve the return loss and the insertion loss of the signal path. Alternatively, the designer may, instead of narrowing, widen a portion of the middle layer signal trace 34, thereby forming a capacitive section, and adjust the length and width of the capacitive section for improved performance.

When a system design employing the present invention has been adjusted for good performance over one range of frequencies, and it is desired to use the system over a different range of frequencies, it may be necessary to repeat the tuning process for the new frequency range.

The grounding system of the present invention is described above, and illustrated in FIG. 5, in the context of a signal path having a first transition from coaxial transmission line to coplanar-over-ground, and a second transition from coplanar-over-ground to stripline. The invention, however, is not limited to such a pair of transitions. It may be used, for example, in a signal path without a second transition, or one in which the second transition is to microstrip transmission line. A transition from coplanar-over-ground to microstrip may be accomplished, for example, by flaring away the top layer ground, i.e., gradually increasing both the width of the top layer signal trace 30, and the gaps between the top layer signal trace 30 and the ground conductor regions on both sides of the signal trace 30, so as to keep the characteristic impedance constant, until the top layer ground conductor 25 is on both sides sufficiently distant from the signal trace 30 to have a negligible effect.

The method for connector grounding of the present invention is not limited to PWBs with three conductive layers, also known as three-layer boards, but may be employed with single-layer boards, two-layer boards, four layer boards, or PWBs with an arbitrary number of conductive layers. In each case the ground tab or tabs 23 may be installed so as to connect the connector frame 10 to a top layer ground conductor 25. The connection of the connector frame 10 to ground conductors in other layers may be accomplished by one of, or a combination of: tabs connecting the connector frame 10 to a top layer ground conductor 25, vias from a top layer ground conductor 25 to ground conductors in other layers, vias from the bottom layer ground 32 to ground conductors in other layers, vias connecting ground conductors in intermediate layers, and direct contact, or adhesion using a conductive epoxy film 15, between the PWB shelf 12 and bottom layer ground 32.

Although limited embodiments of a grounding system for an array of blind-mate coaxial connectors have been specifically described and illustrated herein, many modifications and variations will be apparent to those skilled in the art. Accordingly, it is to be understood that the grounding system constructed according to principles of this invention may be embodied other than as specifically described herein. The invention is also defined in the following claims.

What is claimed is:

1. A system for forming a plurality of electrical connections to one or more conductive areas on a printed wiring board (PWB), the system comprising:

a connector frame attachable to a PWB, the connector frame having at least one surface portion adjacent each of the conductive areas of the PWB;

each of the surface portions being configured to receive a separate conductive tab to connect the surface portion to one of the conductive areas of the PWB, wherein the surface portions are substantially coplanar with a surface of the PWB, the system further comprising a plurality of conductive tabs for connecting one or more of the surface portions to one or more of the conductive areas of the PWB, wherein the conductive tabs are secured to the surface portions and to the conductive areas of the PWB with conductive epoxy.

2. The system of claim 1, wherein the conductive tabs are made of sheet metal.

3. The system of claim 1, wherein the conductive tabs are plated with one or more layers of metal.

4. The system of claim 1, wherein the conductive tabs have a "U" shape.

5. A system for forming a plurality of electrical connections to one or more conductive areas on a printed wiring board (PWB), the system comprising:

a connector frame attachable to a PWB, the connector frame having at least one surface portion adjacent each of the conductive areas of the PWB;

each of the surface portions being configured to receive a separate conductive tab to connect the surface portion to one of the conductive areas of the PWB, wherein the surface portions are substantially coplanar with a surface of the PWB, and wherein the surface portions are the end surfaces of relief cuts in the connector frame.

6. A method of forming a plurality of ground connections between conductive areas on a PWB and a connector frame for holding coaxial connectors, the method comprising:

providing the connector frame with at least one surface portion adjacent each of the conductive areas on the PWB;

securing one or more separate conductive tabs to one or more of the surface portions and securing one or more of the conductive tabs to one or more of the conductive areas, wherein the surface portions comprise one or more shelves, substantially coplanar with a surface of the PWB, and wherein the act of securing one or more conductive tabs to one or more of the surface portions is performed using conductive epoxy.

7. The method of claim 6, wherein the conductive tabs are substantially flat.

8. The method of claim 6, wherein the conductive tabs have a "U" shape.

9. A method of forming a plurality of ground connections between conductive areas on a PWB and a connector frame for holding coaxial connectors, the method comprising:

providing the connector frame with at least one surface portion adjacent each of the conductive areas on the PWB;

securing one or more separate conductive tabs to one or more of the surface portions and securing one or more of the conductive tabs to one or more of the conductive areas, wherein the surface portions comprise one or more shelves, substantially coplanar with a surface of the PWB, and wherein the act of securing one or more of the conductive tabs to one or more of the conductive areas is performed using conductive epoxy.

10. The method of claim 9, wherein the conductive tabs are substantially flat.

11. The method of claim 9, wherein the conductive tabs have a "U" shape.

* * * * *